US006086649A

United States Patent [19]

Tuvin et al.

[11] Patent Number: 6,086,649

[45] Date of Patent: Jul. 11, 2000

[54] HOLDER FOR A VACUUM CLEANER DUST BAG

[75] Inventors: Lars Tuvin, Knivsta; Göran Sjöberg, Kungsängen, both of Sweden

[73] Assignee: Aktiebolaget Electrolux, Stockholm, Sweden

[21] Appl. No.: 09/030,584

[22] Filed: Feb. 25, 1998

[30] Foreign Application Priority Data

Mar. 19, 1997 [SE] Sweden ..... 9701006

[51] Int. Cl.[7] ..... B01D 46/02

[52] U.S. Cl. ..... 55/367; 55/369; 55/373; 55/377; 55/378; 55/DIG. 2

[58] Field of Search ..... 55/367, 369, 373, 55/377, 378, DIG. 2, DIG. 3

[56] References Cited

U.S. PATENT DOCUMENTS 3,432,998 3/1969 Downey ..... 55/367
5,089,038 2/1992 Kopco et al. ..... 55/378
5,092,915 3/1992 Larkner ..... 55/DIG. 2
5,464,460 11/1995 Bosses ..... 55/DIG. 2

FOREIGN PATENT DOCUMENTS 506048 10/1951 Belgium ..... 55/367

OTHER PUBLICATIONS

Swedish Application No. SE–A–8303921–4 Jan. 23, 1984.

*Primary Examiner*—Richard L. Chiesa
*Assistant Examiner*—Minh-Chau T. Pham
*Attorney, Agent, or Firm*—Pearne, Gordon, McCoy & Granger LLP

[57] ABSTRACT

A holder (10) for a vacuum cleaner dust bag which is removably arranged in the vacuum cleaner and includes a sleeve (14) on which an open end (13) of the bag (11) is received. Two or more clamping blocks (17) at least partly surround the sleeve and can be moved in a radial direction toward and away from the sleeve in order to secure the dust bag to the holder and release the dust bag from the holder.

12 Claims, 2 Drawing Sheets

HOLDER FOR A VACUUM CLEANER DUST BAG

BACKGROUND OF THE INVENTION

The present invention generally relates to a holder for a vacuum cleaner dust bag and, more specifically, to a dust bag holder which is removably arranged in a vacuum cleaner and which includes a sleeve on which an open end of a bag can be received.

It is previously known, see FR 1493194, to use an air pervious bag for separating and collecting dust in a vacuum cleaner. The bag is placed in a chamber through which air flows to a fan unit. The dust bag is secured on a sleeve in the chamber. The sleeve is, by means of a hose, connected to the nozzle of the vacuum cleaner. The bag is clamped to the sleeve by means of two clamp blocks which are pivotally arranged in the vacuum cleaner.

This arrangement has certain advantages because simple, cheap bags can be used which need not be equipped with a plate which normally covers the opening of the bag and which is provided with sealing means abutting the sleeve. Unfortunately, this arrangement has several drawbacks. The most significant drawback is that emptying the bag is unhygienic since the operator has to grip the bag in order to remove the bag from the vacuum cleaner, causing collected dust to easily blow out through the opening of the bag. Another drawback is that, because of the limited space, it is rather complicated to put a new bag on the sleeve and to get the bag to stay in the correct position until the clamp blocks have been activated to retain the bag in place. A further drawback is that the design of the vacuum cleaner becomes complicated.

It is also previously known, see SE-A-8303921-4, to use a holder which is removably arranged in the vacuum cleaner and which is provided with a sleeve on which a bag can be secured by a clamping arrangement. However, when removing the bag from the sleeve the operator has to grip the bag which makes handling unhygienic. Putting a new bag on the sleeve also causes some problems since the clamping means are not integrated with the holder, but rather are separate parts which have to be clamped manually around the bag.

Therefore, there exists a need in the art for a dust bag holder which permits the use of simple, cheap bags and wherein removal and replacement of bags is simplified.

SUMMARY OF THE INVENTION

An object of the present invention is a vacuum cleaner dust bag holding arrangement which eliminates the above-mentioned drawbacks and which allows the use of simple, cheap bags.

In accordance with the present invention, a holder for a vacuum cleaner dust bag includes a sleeve over which an open end of the bag is received. The holder also includes a plurality of clamp blocks which at least partially surround the sleeve. The clamp blocks are adapted to move radially toward and away from the sleeve in order to secure the bag to the holder.

In further accordance with the present invention, the holder also includes a pair of handle parts which are manually grasped to facilitate insertion and removal of the bag and holder from the vacuum cleaner. The sleeve, the clamp blocks and the handle parts are secured to a resilient plate. Movement of the handle parts toward each other causes the plate to bend and move the clamp blocks relative to the sleeve and thereby releases the bag from the holder.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
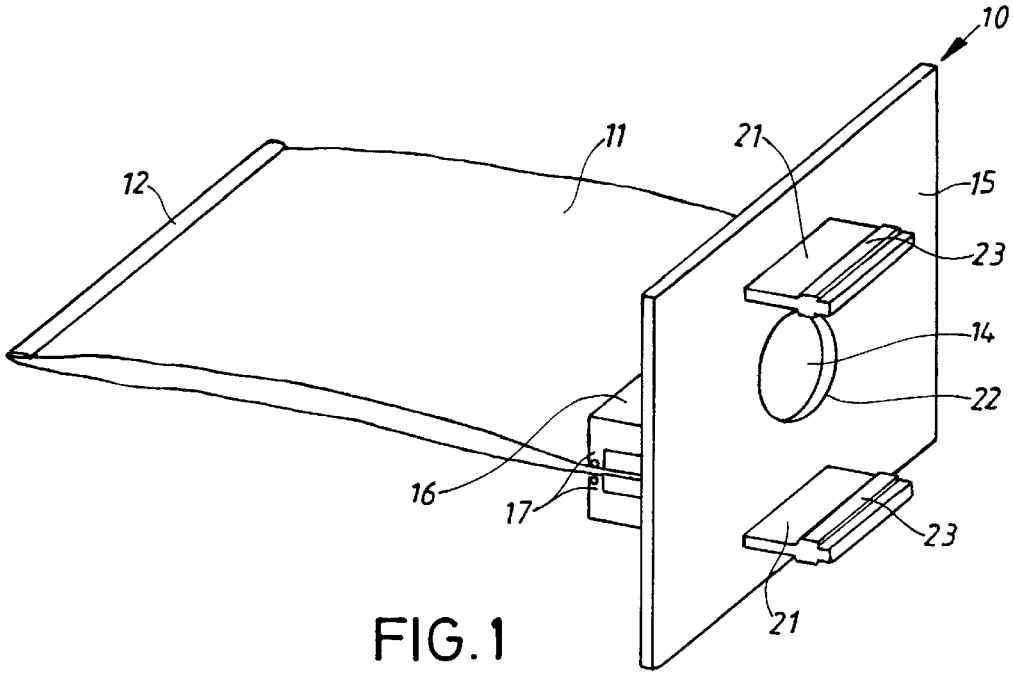
FIG. 1 is a perspective view of a first embodiment of a holder with a dust bag secured thereto.

It should be initially noted that in the detailed description which follows, identical components have the same reference numeral, regardless of whether they are shown in different embodiments of the present invention. It should also be noted that, in order to clearly and concisely disclose the present invention, the drawings may not necessarily be to scale and certain features of the invention may be shown in somewhat schematic form.

Figure 3:
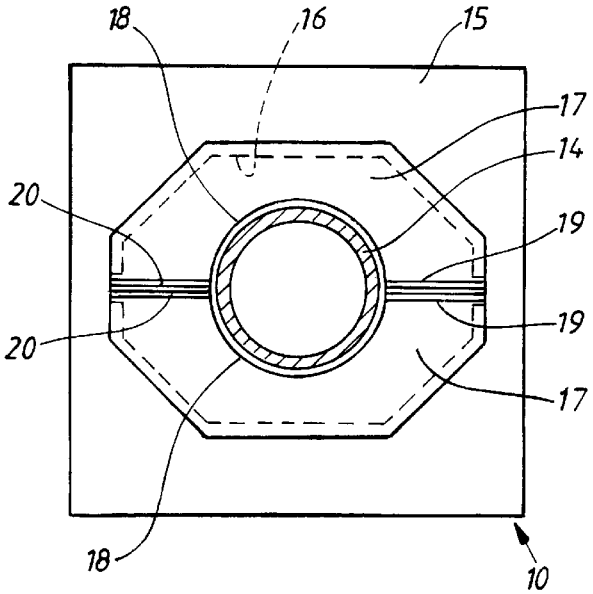
FIG. 3 is a cross-section as seen along line III—III in FIG. 2.
Figure 2:
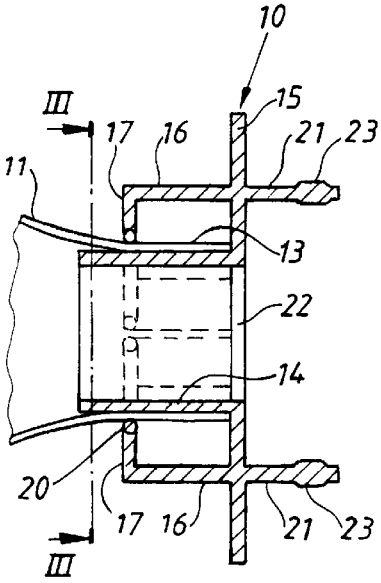
FIG. 2 is a vertical cross-section through the holder shown in FIG. 1.

FIGS. 1–3 show a holder 10 to which a dust bag 11 of air pervious filter material is secured. The dust bag 11 includes a tube shaped, flat work piece with a closed end 12 and an opposite, open end 13. The open end 13 of the bag 11 is placed over or around a sleeve 14 which extends from a plate 15 made of a resilient material. The plate 15 also supports, via extending flange parts 16, two clamp blocks 17. Each clamp block 17 extends parallel to the plate 15 and is spaced a distance from the plate 15, as seen in the length direction of the sleeve 14.

With specific reference to FIG. 3, each clamp block 17 has a semi-circular or curved recess 18 and a peripheral area 19 facing against the peripheral area of the other clamp block. The peripheral area 19 and the semi-circular recess 18 are provided with a sealing member 20.

The plate 15 also includes two relatively stiff handle parts 21 which are located at each side of the parting plane between the clamp blocks 17 as seen in the length direction of the sleeve 14. The handle parts 21 extend perpendicular to the plate 15 and in an opposite direction relative to the sleeve 14, as illustrated in FIG. 2. The handle parts 21 are placed at each side of a circular opening 22 in the plate 15 which serves as the inlet to the sleeve 14. The handle parts 21 preferably include grooves 23 (or ridges) to facilitate manual grasping and handling of the holder 10.

The device is used in the following manner. In order to insert a dust bag 11 in the holder 10, the two handle parts 21 are, by means of the fingers of the operator, pressed toward each other. This causes the plate 15 to bend and thereby separates the clamp blocks 17 radially from each other and the sleeve 14 to permit placement of the open end 13 of the dust bag 11 around the sleeve 14. The operator then releases the handle parts 21, causing the clamp blocks 17 to move radially toward the sleeve 14 and thereby clamp the bag 11 about the sleeve 14 while the outside surface of the open end 13 of the bag 11 surrounding the sleeve is clamped between the clamp blocks 17.

With the bag securely and sealing received on the sleeve 14, the holder 10 can then be inserted and secured in the dust chamber of the vacuum cleaner after which the end of a tube joint communicating with the vacuum cleaner hose is moved into engagement with the area about the opening 22 of the plate such that the air flowing through the hose will be directed into the dust bag.

When the dust bag 11 is full and is to be replaced, the holder 10 together with the bag 11 is removed from the vacuum cleaner after which the holder 10 is placed above a waste container or the like with the bag facing the waste container. Pressing the handle parts 21 toward one another causes the clamp blocks 17 to radially separate from each other and from the sleeve 14, releasing the bag and permitting the bag 11 to fall down into the waste container. A new bag can then be placed on the holder in the previously-described manner.

Figure 4:
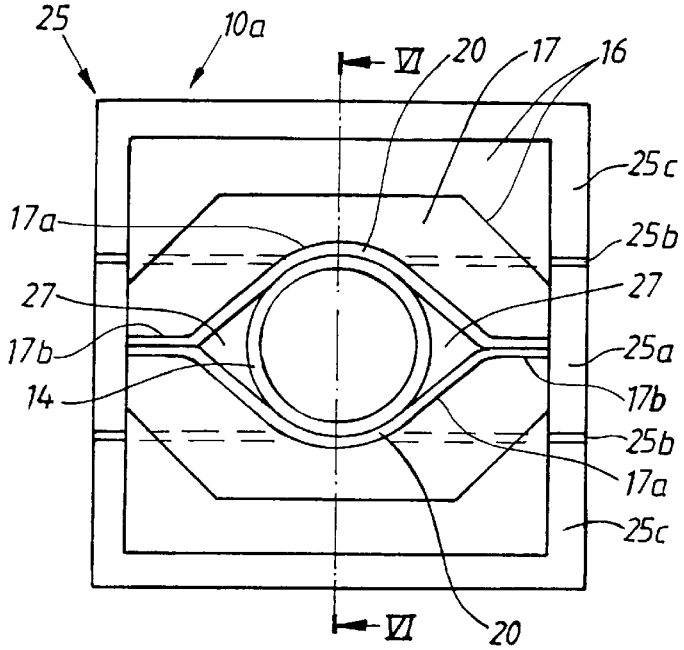
FIG. 4 is a rear side view of a holder according to a second embodiment of the present invention.
Figure 5:
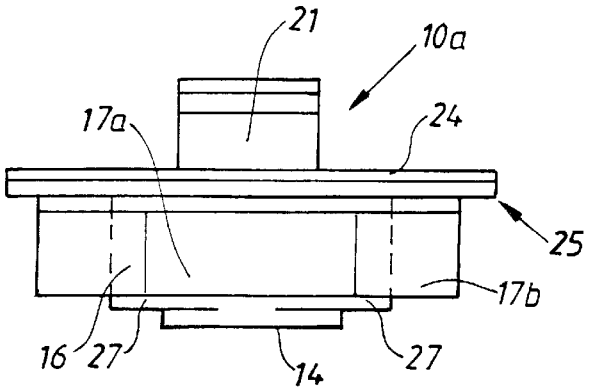
FIG. 5 is a top view of the holder shown in FIG. 4.
Figure 6:
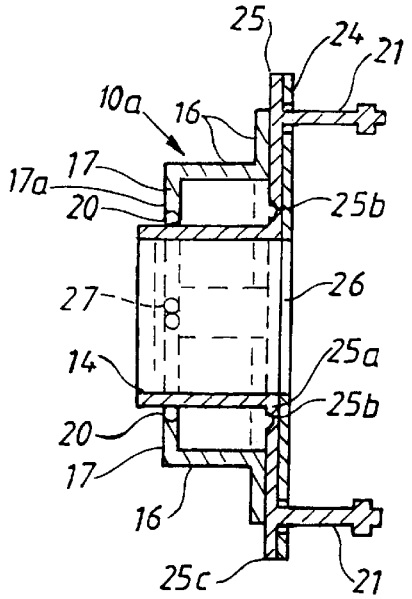
FIG. 6 is a vertical cross-section of the holder as seen along line VI—VI in FIG. 4.

A second preferred embodiment of a holder 10*a* is shown in FIGS. 4–6. The holder 10*a* comprises a first plate 24 and a second plate 25. The first plate 24 is preferably formed from a resilient metal material while the second plate 25 is preferably formed from a plastic material. The first plate 24 is affixed at a central part 25*a* of the second plate 25. The central part 25*a* of the second plate 25 is connected to outer parts 25*c* of the second plate 25 via pivots 25*b*, which are preferably designed as grooves in the second plate 25 and define living hinge-type structures.

The outer parts 25*c* support flange parts 16 for clamp blocks 17. The clamp blocks 17 include an inner curved portion 17*a* and a planar portion 17*b*. The planar portions 17*b* sealingly engage one another (FIG. 4). As described previously, the clamp blocks include sealing means 20. The central part 25*a* of the second plate 25 includes a sleeve 14 having a tube-shaped opening which is concentric with a circular opening 26 in the first plate 24.

The outer opposite sides of the sleeve 14 are provided with triangular beads or extension members 27 which extend from the second plate 25. The beads or extension members 27 are surrounded by the clamp blocks 17 and engaged by the sealing means 20. More specifically, the curved portion 17*a* of the clamp blocks 17 sealingly engages the sleeve 14 and the triangular beads or extension members 27. The outer part 25*c* of the second plate 25 is also provided with handle parts 21 which extend through openings in the first plate 24 (FIG. 6).

The second preferred embodiment shown in FIG. 4–6 functions similarly to the previously-described first embodiment shown in FIG. 1–3. However, in the second embodiment the clamping forces of the clamping blocks 17 are mainly created by the resilient plate 24. When the handle parts 21 are pressed toward each other, the outer parts 25*c* of the second plate 25 will bend to the right in FIG. 6 about the pivots 25*b*. Accordingly, the clamp blocks 17 move radially away from the sleeve 14 to permit placement of a bag on the sleeve 14. Since the outside of the sleeve 14 is provided with the beads or extension members 27, the bag opening will also surround the beads which ensures creation of a good seal when the handle parts 21 are released to permit the clamp blocks to move under the influence of the inherent spring forces of the plate 24 and press the bag toward the sleeve 14 and the beads 27. As such, the first or inner portion of the bag will be clamped between the inner curved portion 17*a* of the clamp blocks 17 and the sleeve 14 and beads 27. The second or outer portion of the bag will be clamped between the outer planar portion 17*b* of the clamp blocks 17.

While the preferred embodiment of the present invention is shown and described herein, it is to be understood that the same is not so limited but shall cover and include any and all modifications thereof which fall within the purview of the invention.

What is claimed is:

1. A holder for a vacuum cleaner dust bag, said holder (10) being removably arranged in a vacuum cleaner and comprising a sleeve (14) over which an open end of the bag (11) is received, said holder (10) comprises a plurality of clamp blocks (17) which at least partially surround the sleeve, said clamp blocks being movable toward and away from the sleeve in order to secure the bag between the clamp blocks and the sleeve, said holder also including at least one handle part (21) by means of which the holder and bag (11) are manually removed from the vacuum cleaner, and wherein said sleeve (14), said clamp blocks (17) and said at least one handle part (21) are secured to a plate (15), said at least one handle part being operably connected to the clamp blocks (17) such that movement of said at least one handle part causes said clamp blocks to move away from said sleeve to thereby release the bag from said holder.

2. A holder according to claim 1, wherein the plate (15) is made from a resilient material.

3. A holder according to claim 1, wherein the plate (25) includes a central part (25*a*) and an outer part (25*c*), said sleeve being secured to said central part and said clamp blocks being supported by said outer part, and wherein said inner and outer parts are connected to each other by a flexible connection (25*b*).

4. A holder according to claim 3, wherein the plate (25) is secured to a second plate (24), said second plate being formed from a resilient material and at least partially supporting said at least one handle part (21).

5. A holder according to claim 1, wherein each clamp block (17) includes a first clamping surface (18) and a second clamping surface (19), each of said first clamping surfaces cooperates with the sleeve to sealingly receive a first portion of the bag, said second clamping surface of said first clamping block cooperating with said second clamping surface of said second clamping block to sealingly receive a second portion of the bag.

6. Holder according to claim 5, wherein the clamping surfaces (18, 19) are provided with at least one sealing means (20) which abuts an outside surface of the bag.

7. A holder according to claim 5, wherein said first clamping surface is curved and said second clamping surface is generally planar.

8. A holder according to claim 4, wherein each clamp block (17) includes an inner portion (17*a*) and an outer portion (17*b*), each of said inner portions cooperates with the sleeve to sealingly receive a first portion of the bag, said outer portion of said first clamping block cooperating with said outer portion of said second clamping block to sealingly receive a second portion of the bag.

9. A holder according to claim 8, wherein said inner portion surrounds at least a portion of said sleeve.

10. A holder according to claim 9, wherein said sleeve includes first and second oppositely extending extension members, said first portion of said bag being disposed between said sleeve, said extension members, and said clamping block inner portion.

11. A holder according to claim 10, wherein said clamping block inner portion includes a curved clamping surface and said clamping block outer portion includes a planar clamping surface.

12. A holder according to claim 11, wherein said clamping surfaces are provided with at least one sealing means (20) which abuts an outside surface of the bag.

* * * * *